US008141629B2

(12) United States Patent
Angman

(10) Patent No.: US 8,141,629 B2
(45) Date of Patent: Mar. 27, 2012

(54) WELL STRING CENTRALIZER AND METHOD OF FORMING

(75) Inventor: Per G. Angman, Calgary (CA)

(73) Assignee: Tesco Corporation, Houston, TX (US)

( * ) Notice: Subject to any disclaimer, the term of this patent is extended or adjusted under 35 U.S.C. 154(b) by 97 days.

(21) Appl. No.: 12/302,553

(22) PCT Filed: May 31, 2007

(86) PCT No.: PCT/CA2007/000980

§ 371 (c)(1),
(2), (4) Date: Dec. 11, 2008

(87) PCT Pub. No.: WO2007/137435

PCT Pub. Date: Dec. 6, 2007

(65) Prior Publication Data

US 2009/0151931 A1 Jun. 18, 2009

(51) Int. Cl.
*E21B 17/10* (2006.01)

(52) U.S. Cl. ..... 166/241.6; 166/241.1; 166/241.4; 175/325.5

(58) Field of Classification Search ..... 166/241.6, 166/380, 241.1, 241.4; 175/325.5
See application file for complete search history.

(56) References Cited

U.S. PATENT DOCUMENTS 2,715,552 A * 8/1955 Lane ..... 175/325.5
4,630,833 A * 12/1986 Boyle et al. ..... 277/500
5,833,018 A * 11/1998 von Gynz-Rekowski . 175/325.3

FOREIGN PATENT DOCUMENTS

WO WO02/02904 A1 * 1/2002

* cited by examiner

*Primary Examiner* — Cathleen Hutchins
(74) *Attorney, Agent, or Firm* — Bracewell & Giuliani LLP

(57) ABSTRACT

Centralizers including at least a portion formed of a first material and at least one end band secured to the first material and formed of a second material. The end band being installed to resist detachment from the portion formed of the first material.

4 Claims, 2 Drawing Sheets

WELL STRING CENTRALIZER AND METHOD OF FORMING

BACKGROUND

Well strings such as drill strings, production strings, drive strings, etc. are used in borehole operations. During such operations, it may be useful or necessary to centralize the well string to prevent it from wearing against or sticking to the borehole wall, to ensure an annular space is maintained between the wells string and the borehole wall, etc. Centralizers, which are sometimes alternately termed stabilizers, have been used to effect such centralization. Centralizers generally each include an axial bore and an outer surface and are installed to encircle the wellstring with a portion of the well string extending through the bore of the centralizer.

Plastic centralizers are known. Some plastic centralizers have suffered from damage at their ends where the centralizer is acted on by the formation and the casing about which it is installed. To address the end-wise damage of the centralizers, metal rings have been installed as by securing to or imbedding in the ends of some centralizers. Metal rings are intended to provide reinforcement, stabilization and enhanced durability at the ends of the centralizer, where it often undergoes greater stresses as by abutment against borehole ledges, other string components such as collars, shoulders, rings, etc. However, such rings have in some cases become detached from the plastic part of the centralizer or the plastic material of the centralizer has deformed to ride up over the ring.

SUMMARY

According to one aspect of the present invention, there is provided a centralizer comprising: a body including a bore, a first end and a second end, the first and second ends extending circumferentially about the bore, the body being formed of a first material; and a band embedded at least in part in the body substantially encircling the bore and positioned adjacent at least one of the first end and the second end, the band formed of a second material more durable than the first material and including an installation portion with a plurality of material engagement extensions formed as returns and about which the first material is positioned.

According to another aspect of the present invention, there is provided a wellstring assembly comprising; a tubular section and a tubular device including a bore therethrough, the tubular device installed on the tubular section with the tubular section extending through the bore, the tubular device further including a body having a first end and a second end, the first and second ends extending circumferentially about the bore, the body being formed of a first material; and a band embedded at least in part in the body substantially encircling the bore and positioned adjacent at least one of the first end and the second end, the band formed of a second material more durable than the first material and including an installation portion with a plurality of material engagement extensions formed as returns and about which the first material is positioned.

According to another aspect of the present invention, there is provided a method for manufacturing a centralizer, the method comprising: providing a band for mounting adjacent an end of a centralizer body to be formed, the band including an installation portion with a plurality of material engagement extensions forming returns and applying a first material selected to form the centralizer body over at least a portion of the installation portion of the band such that the material forming the body is positioned about the returns of the material engagement extensions.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS OF THE INVENTION

Figure 1:
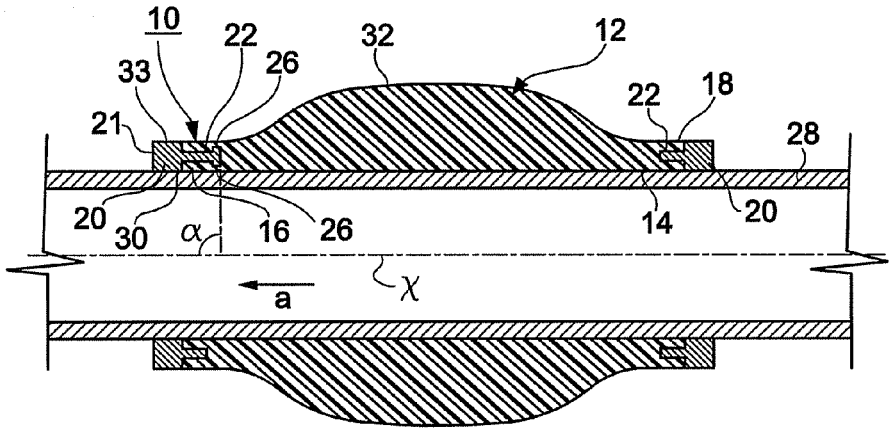
FIG. 1 is a quarter sectional view through a centralizer according to one aspect of the present invention on a well string tubular.

The description that follows, and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

Centralizers are described herein including at least a portion formed of a first material and at least one end band secured to the first material and formed of a second material. The end band being installed to resist detachment from the portion formed of the first material.

According to one aspect, a centralizer 10 includes a body 12 with a bore 14 extending between a first end 16 and a second end 18. The first and second ends extend circumferentially defining openings to bore 14.

Centralizer body 12 may be formed of a first material and an end band 20 secured at least in part to the body 12 substantially encircling the bore and positioned adjacent at least one of the first end and the second end, the band formed of a second material more durable than the first material.

As will be appreciated, the centralizer may be formed to be retained over a well string tubular 28, such as drill pipe or casing including various kinds of tubulars, casing joints, liners, screens, etc. The centralizer may be formed to be rotating or substantially non-rotating on the tubular after installation. Centralizer 10 may be formed to be handled as one piece or may be formed in sections for assembly to form the centralizer. In one embodiment, the body is continuous about the bore and the centralizer is retained over a wellbore tubular by insertion of the tubular through the bore.

An inner-facing surface defining bore 14 and an outer surface 32 opposite the inner facing surface may be defined on the centralizer body. The outer surface may include vanes, protrusions, inserts, hardening, etc., as desired, to control flow therepast or to select wear, bearing or spacing properties relative to the formation and/or borehole in which the centralizer is to be used. The outer surface is formed at least to allow the centralizer to provide positive stand off of the tubular from the formation wall.

Since the band is intended to reinforce the end of the centralizer, the band may be formed of a second material more durable than the first material. The material of the end band, termed herein the second material, may have a hardness, strength, durability, or stiffness greater than the material of the first material, which is the material forming the centralizer body. In one embodiment, the second material may be described as having a Young's modulus greater than that of the first material. For example, the first material may have a Young's modulus of 550,000 to 1,000,000 psi, while the second material may have a Young's modulus of greater than 10,000,000 psi.

The first material may include one or more of polymeric material such as a plastic, a rubber, an elastomer, a ceramic, a cermet, a carbide, a soft metal (i.e. aluminum), etc. that is durable and able to operate for at least a period in wellbore conditions. Of course the materials may include reinforcements, fillers, etc. Examples of materials particularly suitable to form a centralizer body are well known in the art of "plastic centralizers", such as for example polyurethane, polyphthalamide, aliphatic polyketone, nylon, polyamide, and/or various other thermoplastics. The material of the body may be employed to form the body as by processes including molding, milling, forming, etc.

In one embodiment, the second material may include a metal such as various forms of bronze, steel, etc.

The band 20 may be used to reinforce an end of the centralizer so that the centralizer resists deformation and damage at that end. To reinforce both ends of the centralizer, a band may be installed at each end. Band 20 is formed to substantially encircle the end and in one embodiment may be continuous, as in the form of a ring such that it can completely encircle the bore of the centralizer and extend a distance into the body of the centralizer. If it is desired to space the band from contact with the tubular on which the centralizer is to be installed, the inner diameter 30 of the band may be greater than the inner diameter of bore 14 of the body. This may form a space between the band and the tubular such that wear between the parts may be avoided. Inner diameter 30 of band 20 is not in contact with any portion of centralizer body 12.

The band may be positioned adjacent the end of the centralizer for example at or near the end. The band may be, for example, exposed in part on the end or may be embedded entirely in the material of the body near the outer limit of the end in which it is installed.

In the embodiment illustrated in FIG. 1, band 20 may include an end-facing portion 21 and an installation portion 22 with a plurality of material engagement extensions each forming a return 26 about which the first material is positioned. The returns become embedded in the centralizer body to secure the band to the centralizer body.

Figure 3:
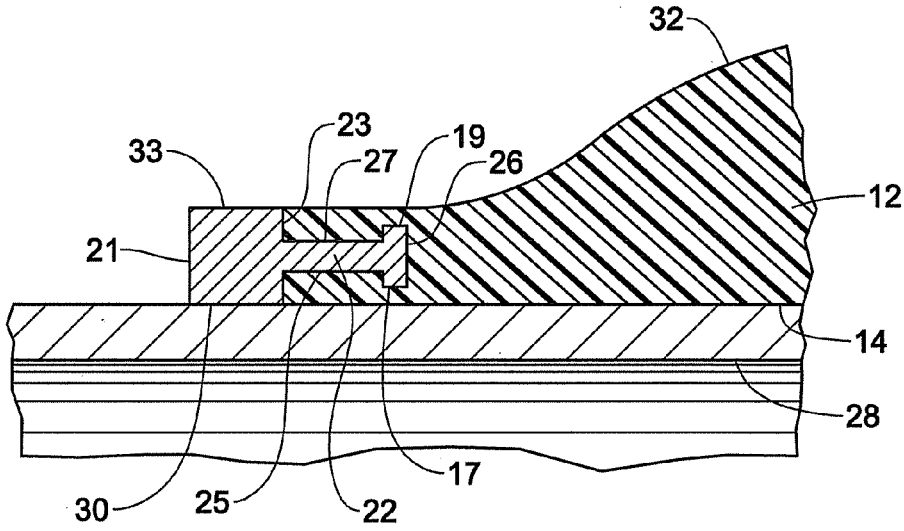
FIG. 3 is an enlarged quarter sectional view of the left-hand portion of FIG. 1.

The band includes installation portion 22, which may be an extension, an annular flange, a sleeve, fingers, or other part of the band. Where the band is in the form of a ring, for example, it may be considered to have an inner-facing wall or inner diameter 30 which defines a bore through the ring, an outer wall 33 opposite the inner-facing wall on either side of end-facing portion 21. Referring to FIG. 3, installation portion 22 may join and extend from an end 23 of the ring opposite end-facing portion 21, and/or from one or both of walls 30, 33. Ends 23 are flat surfaces perpendicular to axis of centralizer body 12. In the illustrated embodiment, for example, where end-facing portion 21 is exposed on an end of the centralizer, installation portion 22 may be, for example, on the opposite end 23 and intended to be fully imbedded in the material of the body. Opposite end 23 serves as a bonding surface to which the centralizer body 12 bonds. Installation portion 22 comprises a metal sleeve with an inner diameter 25 greater than inner diameter 30 of band 20 and an outer diameter 27 smaller than outer diameter 33 of band 20. Installation portion 22 joins band end 23 midway between band inner diameter 30 and band outer diameter 33. Installation portions 22 have lengths much shorter than a distance from end 23 on one band 20 to the end 23 on the opposite band 20. Centralizer body outer surface 32 is flush with band outer diameter 33 where the centralizer body bonds to end 23.

Installation portion 22 includes a plurality of material engagement extensions each forming a return 26. The material engagement extensions are secured to or formed integral with the band and form a part of the band that can be physically engaged by the material of the centralizer body, as by positioning of the material of the body between the end-facing portion 21 and the returns on the extensions. The returns on the extensions may be formed as enlargements, hooks, flanges (as shown), etc. on the extensions and may be formed to extend at an angle $\alpha$ less than 120° and possibly less than 105° or 90° from the axis x defined along the direction of the dislodgement (arrow a shown for the left hand band of FIG. 1) of the band from the centralizer. The flange return 26 is shown more clearly in FIG. 3 has an inner diameter 17 greater than an inner diameter of bore 14. Flange return 26 has an outer diameter 19 less than any portion of body outer surface 32. Flange return 26 is thus fully embedded in the material of body 12. As will be appreciated, the band may generally have the tendency to become dislodged through various forces including, separation of connected parts, material damage of individual parts of the centralizer, generally through the path of least resistance which may be toward any exposed surface of the band, etc. The usual direction of dislodgment of the band from the centralizer will be generally along the long axis along the length of the bore of the band, which for example, in FIG. 1 is substantially aligned with axis x, which is the long axis of the centralizer through its ends. The returns may be angled with or out of (as shown) the circumferential curvature of the band.

In the illustrated embodiment of FIG. 1, portion 22 is formed as a flange on the band extending the full circumference thereof. Returns 26 extend out as flanges from the annular flange one extending radially inwardly and one extending radially outwardly spaced apart about the full circumference of the band each at an angle $\alpha$ approximately 90° from axis x. As such, portion 22, at the position of returns 26, forms a T-shaped structure in section wherein the material of body 12 can surround portion 22 and be positioned between returns 26 and end-facing portion 21. In this way, band 20 is not only secured to body 12 by adhesion between the parts, but also through physical interlocking engagement.

Figure 2:
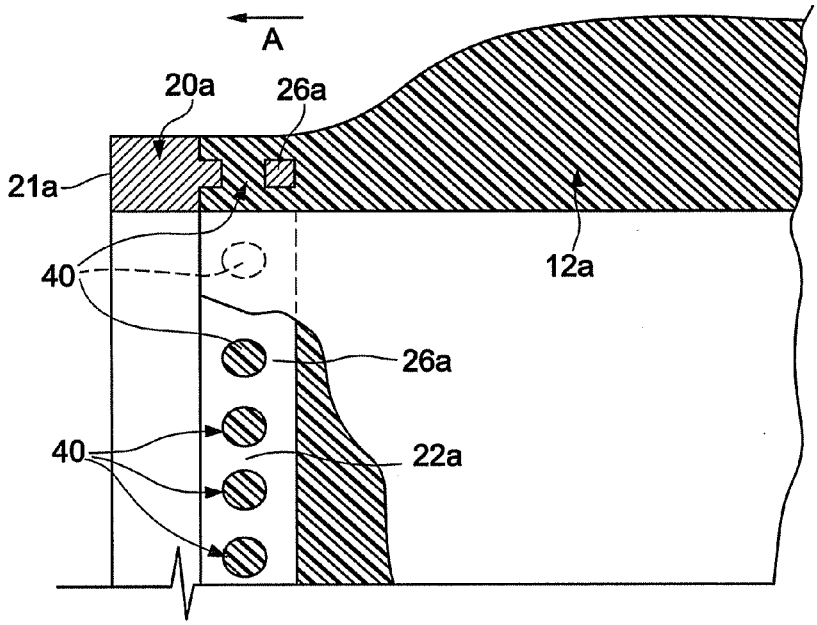
FIG. 2 is an enlarged sectional view through an end of a centralizer according to the present invention with a portion of the centralizer body cut away to expose a band therein.
Figure 4:
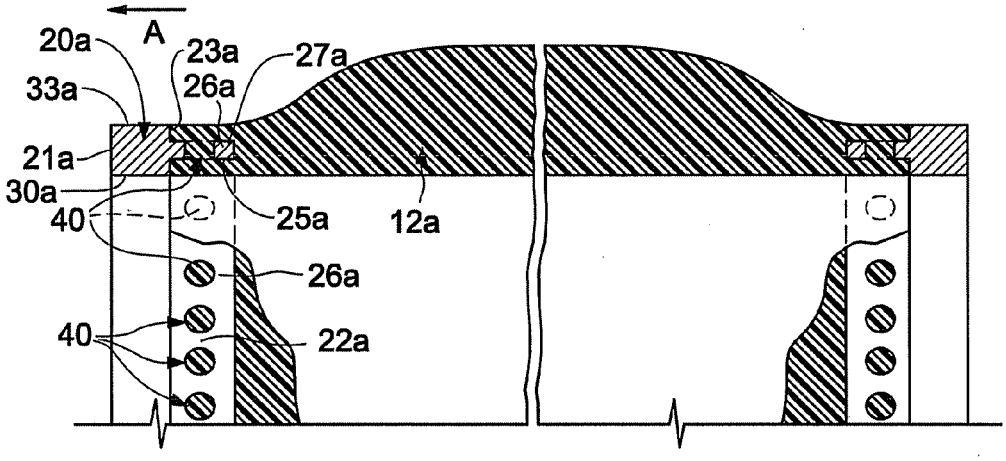
FIG. 4 is a view similar to FIG. 2, but showing both ends of the centralizer.

In the illustrated embodiment of FIGS. 2 and 4, a band **20*a* is shown wherein the plurality of material engagement extensions are formed as returns 26*a* extending with the curvature of the band. Returns 26*a* connect back to the material of installation portion 22*a*. As such, portion 22*a* is formed as a sleeve or flange extending along the circumference of the band. The flange comprises a cylindrical wall having apertures 40 therethrough. Installation portion 22***a* joins a bonding surface 23*a* of band 20*a* to which centralizer body 12*a* bonds. Installation portion 22*a* has an inner diameter 25*a* greater than inner diameter 30*a* of band 20*a*. Installation portion 22*a* has an outer diameter 27*a* smaller than outer diameter 33*a* of band 20*a*. Apertures 40 are spaced circumferentially around the cylindrical walls of returns 26*a*. In the finished centralizer, apertures 40 may be filled with material of the body 12*a* so that the band is firmly engaged by the body material and resists being pulled therefrom, the direction of which generally may occur along arrow A. In the illustrated embodiment, the flange forms an installation portion that is less thick than the opposite, exposed end-facing portion 21*a* of the band. In this embodiment, the returns 26*a* are angled substantially with the circumferential direction of the band, which is formed as a ring.

In order to manufacture a centralizer such as that of FIG. 1 or 2, a band is provided for mounting adjacent an end of a centralizer body to be formed. The band includes an installation portion with a plurality of material engagement extensions formed as returns. Thereafter, a first material, selected to form the centralizer body, is applied over at least a portion of the installation portion of the band such that the first material forming the body is positioned about the returns of the material engagement extensions. For example, the first material, which is the material forming the body of the centralizer may be positioned between the returns and an end-facing portion of the band.

In one embodiment, the centralizer may be formed by molding. In such an embodiment, the band may be retained in the mold and the first material can be introduced into the mold and into a position about the returns. As will be appreciated, if the method is injection molding, the injected material may be injected about the installation portion. During forming of a centralizer of FIG. 2, for example, the first material of the centralizer, such as a thermoplastic, may be injected about the flange to flow into apertures 40 such that when set, the first material securely holds the ring by physical interlocking engagement on the end of the centralizer.

The provision of an end band with a plurality of returns formed on an installation portion thereof, may resist detachment of the band from the centralizer body.

Of course it is to be understood that although the embodiments of FIGS. 1 and 2 have been described together in this document, they can be used separately or together in various combinations.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. A centralizer comprising:

a body having a bore, a first end and a second end, the first and second ends extending circumferentially about the bore, the body being formed of a polymer material;

an annular metal band having an end with a bonding surface bonded to the first end of the body, the band having an inner diameter free of contact with the body and having an outer diameter flush with an outer diameter of the first end of the body;

a metal sleeve having an end joined to the bonding surface of the band and extending into and embedded within the body, the sleeve having a cylindrical wall with an inner diameter larger than the inner diameter of the band and an outer diameter smaller than the outer diameter of the band, such that both the inner and the outer diameters of the cylindrical wall of the sleeve are embedded within the body; and a flat metal flange on the second end of the sleeve, defining a T-shaped configuration when viewed in cross section, the flange having an inner diameter larger than the inner diameter of the sleeve and an outer diameter smaller than the outer diameter of the sleeve, such that the flange is entirely embedded within the body.

2. The centralizer according to claim 1, wherein the sleeve joins to the band midway between the inner diameter and the outer diameter of the band.

3. A centralizer comprising:

a body having a bore, a first end and a second end, the first and second ends extending circumferentially about the bore, the body being formed of a polymer material;

a pair of annular metal bands, each having an end with a bonding surface bonded to one of the ends of the body, each of the bands having an inner diameter that is free of contact with the body and having an outer diameter that is the same as an outer diameter of the end of the body to which the band is bonded;

a pair of metal sleeves, each having a first end joined to the bonding surface of one of the bands and a second end embedded within the body, each of the sleeves comprising a cylindrical wall having an inner diameter larger than the bore of the body and an outer diameter smaller than the outer diameter of the band to which the sleeve is joined, such that both the inner and the outer diameters of the sleeves are embedded within the body; and a flat metal flange on the second end of each of the sleeves, defining a T-shaped configuration when viewed in cross section, each of the flanges having an inner diameter smaller than the inner diameter of the sleeve to which each of the flanges are joined and larger than the inner diameter of the bore of the body, and each of the flanges having an outer diameter smaller than the outer diameter of the sleeve to which each of the flanges are joined, such that each of the flanges is entirely embedded within the body.

4. The centralizer according to claim 3, wherein each of the sleeves joins to one of the bands midway between the inner diameter and the outer diameter of the band to which the sleeve is joined.

* * * * *